United States Patent [19]

Irresberger

[11] 4,433,945

[45] Feb. 28, 1984

[54] METHOD AND APPARATUS FOR CONTROLLING A MINE ROOF SUPPORT

[75] Inventor: Hermann Irresberger, Essen, Fed. Rep. of Germany

[73] Assignee: Bergwerksverband GmbH, Essen, Fed. Rep. of Germany

[21] Appl. No.: 320,712

[22] Filed: Nov. 12, 1981

[30] Foreign Application Priority Data

Nov. 13, 1980 [DE] Fed. Rep. of Germany ..... 3042749

[51] Int. Cl.[3] ..... E21D 23/16

[52] U.S. Cl. ..... 405/302; 405/290; 405/296

[58] Field of Search ..... 405/302, 295, 292, 297, 405/290, 296; 299/33; 14/71.7; 91/170 MP

[56] References Cited

U.S. PATENT DOCUMENTS

| | | | |
|---|---|---|---|
| 2,644,971 | 7/1953 | Rowe | 14/71.7 |
| 2,846,703 | 8/1958 | Adley | 14/71.7 |
| 3,175,238 | 3/1965 | Pennington | 14/71.7 |
| 3,217,608 | 11/1965 | Bolton | 405/302 X |
| 3,388,413 | 6/1968 | Clarke | 14/71.7 |
| 3,478,522 | 11/1969 | Rieschel | 405/302 X |
| 3,664,138 | 5/1972 | Cooper | 405/302 |
| 4,236,850 | 12/1980 | Koppers | 405/295 X |
| 4,247,226 | 1/1981 | Weirich | 405/302 |
| 4,264,237 | 4/1981 | Irresberger | 405/302 |

*Primary Examiner*—James A. Leppink

*Attorney, Agent, or Firm*—Michael J. Striker

[57] ABSTRACT

In combination with a mine roof support including a sole plate resting on the sole of a mine gallery, a roof shield engaging the roof of the mine gallery, and fluid-operated extensible and collapsible props extending between the sole plate and the roof shield for pressing the latter against the roof, a method for controlling the force at which the roof shield is pressed against the roof of the mine gallery comprising the steps of providing an overpressure valve communicating with the interior of each prop and adjusting the opening pressure of the valve in dependence on the inclination of the props with respect to the sole plate; and an arrangement for carrying out the method.

6 Claims, 1 Drawing Figure

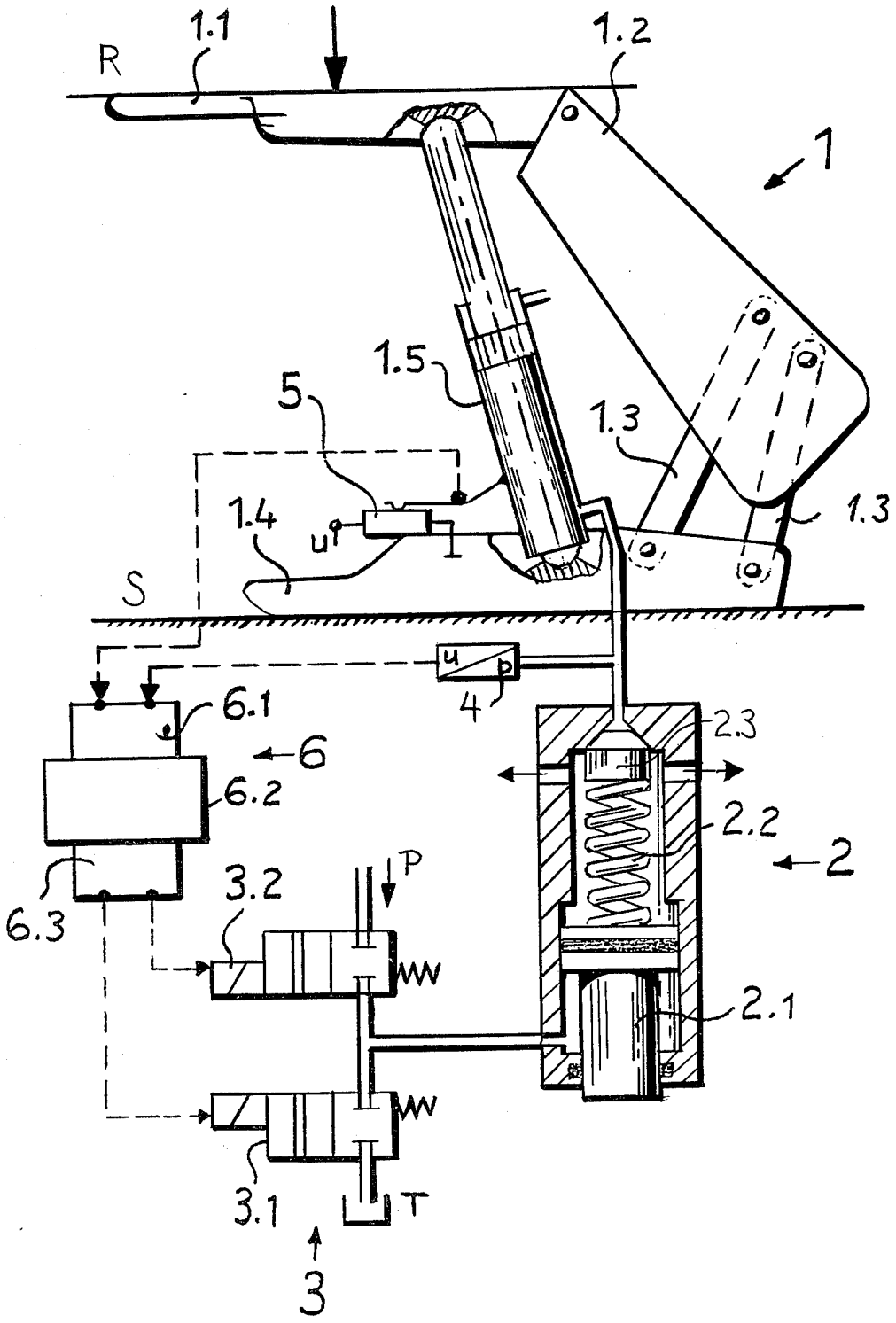
R
1.1
1.2
1
1.5
5
1.3
1.4
u
1.3
S
u
p
4
6.1
6
6.2
2.3
2.2
2
6.3
3.2
P
2.1
3.1
T
3

METHOD AND APPARATUS FOR CONTROLLING A MINE ROOF SUPPORT

BACKGROUND OF THE INVENTION

The present invention relates to a method for controlling the pressures at which fluid-operated extensible and collapsible props arranged between the sole plate of a mine roof support engaging the sole of a mine gallery and a roof shield engaging the roof of the mine gallery press the roof shield against the roof of the mine gallery, and in which the fluid pressure in the props is controlled corresponding to the distance between sole plate and roof shield while overloading of the mine roof support is avoided.

The present invention relates also to an apparatus for carrying out the method.

In mine roof supports, which are especially used in mine galleries in which coal seams are mined, the roof shield and the sole plate are held spaced from each other by pivotally connected fluid-operated extensible and collapsible props to transmit the force of the fluid-operated props to the sole of the mine gallery and to the roof thereof. Since the thickness of the coal seams to be mined often varies considerably at successive stretches, so that the distance between the sole plate and roof shield has to be adjustable within a wide range, the props are usually arranged inclined to the sole plate at an angle differing from 90°. The props transmit therefore in their inclined position only a component of their force to the roof of the mine gallery, which is normal to the roof, so that they must be constructed correspondingly large to produce the necessary forces. The inclination of the props relative to the sole plate changes with the distance of the roof shield from the sole plate. At a greater distance between the sole plate and roof shield, the props are inclined less to the sole plate than at a smaller distance. Correspondingly, the component of the supporting force of said props which is normal to the roof shield is larger at a greater distance between roof shield and sole plate than at a smaller distance between these two components, so that the various elements of the mine roof support, such as the roof shield, the sole plate and the rear shield, have to be correspondingly strongly constructed in order to absorb also the higher mechanical stresses occurring at a large distance of roof shield and sole plate from each other. Such an overdimensioning of the various components of the mine roof support requires not only higher manufacturing costs, but is also detrimental during transport of the mine roof support, during use and maintenance of the same.

SUMMARY OF THE INVENTION

It is an object of the present invention to provide a method and apparatus for controlling the force at which a roof shield of a mine roof support is pressed against the roof of a mine gallery independence on the inclination of the props with respect to the sole plate of the mine roof support or the length of the extended props.

With this and other objects in view which will become apparent as the description proceeds, the method according to the present invention mainly comprises the steps of providing an overpressure valve communicating with one compartment which is formed between the piston and one end of the cylinder in which the piston of each prop is arranged for reciprocation, into which pressure fluid is fed for extending the prop, and adjusting the opening pressure of the overpressure valve in dependence on the inclination of the prop with respect to the sole plate or the extended length of the prop.

At such a method, it is possible to construct the various elements of the mine roof support only under consideration of the force of the prop which acts normal to the mine roof. An overdimensioning of the various construction elements is not necessary any longer. To the contrary, by the adjustment of the opening pressure of the overpressure valve in dependence on the inclination of the prop with respect to the sole plate the force at which the roof shield is pressed against the roof of the mine gallery is derived independent from the distance between the roof shield and sole plate.

According to one arrangement of the present invention the inclination of the prop with regard to the sole plate is measured and the measured value is, transformed in a corresponding control command for controlling the opening pressure of the overpressure valve. At a larger angle between the prop and the sole plate, the opening pressure is correspondingly reduced, and at a smaller angle between these elements correspondingly increased. Thereby it is possible to adjust the opening pressure continuously in correspondence to the inclination of the prop, or to control the opening pressure in individual steps, whereby the sequence between the individual controlling steps may be adjustable in accordance with the respective prevailing conditions.

In accordance with a further construction, not only the inclination of the prop with regard to the sole plate, but also the pressure within the prop is measured, and the thus obtained measuring results are compared with desired results and transformed into control commands for controlling the opening pressure of the overpressure valve. Since the angle at which the prop is inclined with respect to the sole plate is in a certain relationship to the extended length of the prop, it is also possible to use the extended length of the prop as a control dimension for adjustment of the opening pressure of the overpressure valve, and regardless of whether the extended length of the prop or the inclination thereof is used as a control dimension, it is necessary that, during adjustment of the length of the prop, a higher opening pressure of the overpressure valve be established at a smaller distance of the roof shield from the sole plate than at a larger distance of these two elements from each other. Considering these facts, the control of the opening pressure of the overpressure valve can be further improved in that, when the opening pressure of the overpressure valve reaches the adjusted overpressure, the setting process of the prop is automatically stopped. By a corresponding construction of the control itself it is therefore possible, by use of the method according to the present invention, to stop the setting process of the prop automatically in a most favorable manner.

The apparatus for carrying out the above method comprises a control arrangement in which an overpressure valve is coordinated with the prop, in which means for measuring the inclination of the prop relative to the sole plate are provided, cooperating with a transducer for transforming the measuring result of the inclination measuring means into corresponding control signals for the overpressure valve which control the opening pressure of the latter. With such an arrangement, it is therefore possible to regulate the pressure in the prop without considerable expenditure and independent of the distance of the roof shield from the sole plate.

The aforementioned measured value transducer is, in accordance with an advantageous construction, formed as a calculator. This calculator receives the value of an angle measured by the inclination measuring means between the prop and the sole plate and transforms the measured value into a control command for the adjustment of the opening pressure of the overpressure valve. According to a further development, the calculator may start from a predetermined linear characteristic line of construction, i.e. a load-distance diagram during movement of the mine roof support from its largest to its shortest extension, if this is necessary, in that the calculator is programmed to a predetermined characteristic curve. Thereby it is possible to realize inclined or curved characteristic lines, if this is necessary on account of local characteristics.

According to the invention, it is also advantageous if the overpressure valve is constituted by an electromagnetically controlled stop valve, the opening and closing of which is controlled by the pressure in the prop and its inclination with regard to the sole plate. Thereby the pressure in the stop is measured by a pressure indicator and the measured pressure is compared with a desired value. If the measured value is for instance above the desired value, then the overpressure valve is electromagnetically opened until the predetermined desired value is reached.

The advantage of the present invention resides especially in a simple and limited expenditure for the measurement and control means and the technical improvement resides especially in that the pressure in the props may be maintained independent of the distance of the roof shield from the sole of the mine gallery, which leads to an essentially simpler and cheaper construction of the various elements of the mine roof support. Due to the avoidance of overdimensioning of the various elements of the mine roof support, a reduction of the wear of the various elements of the mine roof support, and especially of the control arrangement, is obtained.

The necessary measurement and control devices are distinguished by simple construction. They may also be integrated into an already existing mine roof support, so as to at least contribute to lesser stressing of the various elements of the mine roof support and of the control arrangement. It is thereby advantageous that either the inclination of the prop is measured or that the extended length of the prop is used as control value. Especially during mining of coal seams of small height, it is advantageous to use the extended length of the prop as control value, in order not to limit the narrow work space by an inclination measuring instrument.

The novel features which are considered characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE schematically illustrates a mine roof support and a control arrangement for feeding pressure fluid into the prop thereof, while omitting elements not necessary for the understanding of the invention.

DESCRIPTION OF A PREFERRED EMBODIMENT

The FIGURE schematically illustrates a mine roof support 1 of standard construction arranged between the roof R and the sole S of a mine gallery and comprising a sole plate 1.4 resting on the sole, a roof shield 1.1 pressed by at least one but preferably two parallel hydraulically operated prop means 1.5 against the roof R of the mine gallery. The prop means 1.5 are pivotally connected at opposite ends to the roof shield 1.1 and the sole plate 1.4 and are extendable and collapsible by feeding or discharging pressure fluid via a conduit A connected to a fluid source in the known manner into one of the cylinder compartments of the prop means to one side of the piston thereof. The prop means are usually inclined at an acute angle with respect to the sole plate 1.4 to adapt the mine roof support 1 to the varying distance between the roof R and the sole S of the mine gallery. The mine roof support further includes a rear shield 1.2 pivotally connected at its upper end to the rear end of the roof shield 1.1 and connected in the region of its lower end to the sole plate by two transversely spaced links 1.3.

According to the present invention, an overpressure valve 2 is connected to the cylinder space into which pressure fluid is to be fed via conduit A to expand the prop means 1.5. A fluid return conduit B connected in a fluid circuit in the known manner is shown in the drawing. The opening pressure of the overpressure valve 2 is controlled depending on the inclination or the extension of the prop means 1.5. To vary the opening pressure of the overpressure valve 2 a coiled compression spring 2.2 in the housing of the overpressure valve normally biases the valve member 2.3 to the closed position, and the pressure of the spring 2.2 may be varied by a piston 2.1 reciprocatably arranged in the cylinder space of the valve housing and engaging the spring 2.2 at one end opposite from that which engages the valve member 2.3. The position of the piston 2.1 is controlled by a valve arrangement 3 comprising two solenoid-operated control valves 3.1 and 3.2, of which the valve 3.1, when operated, discharges pressure fluid from below the piston 2.1 into a tank T, whereas the valve 3.2, when operated, feeds pressure fluid, as indicated by the arrow P from a source, not shown in the drawing, below the piston 2.1 of the valve 2.

To operate one or the other of the control valves 3.1 and 3.2, a pressure indicator 4 in form of a pressure-voltage transducer of known construction communicates with a conduit leading from the mentioned cylinder space of the prop means 1.5 to the valve 2, and the electrical signal produced by the transducer is transmitted to a two-channel analog-digital converter 6.1 of a calculator arrangement 6. An indicator 5, in form of a potentiometer of known construction, measures the included angle between the prop means 1.5 and the sole plate 1.4 or the length of the extension of the prop means 1.5 and produces an electrical signal which is also fed into the converter 6.1. The electrical signals introduced into the converter 6.1 are transmitted to a calculator 6.2 which transforms these signals into control signals which are transmitted over a digital impulse transmitter 6.3 of known construction to the control valves 3.1 or 3.2 to thereby change the axial position of the piston 2.1 and therewith the opening pressure of the overpressure valve 2.

It will be understood that each of the elements described above, or two or more together, may also find a useful application in other types of methods and apparatuses for regulating the pressure at which the roof shield of a mine roof support is pressed by hydraulically operated extensible and collapsible props against the roof of a mine gallery, differing from the types described above.

While the invention has been illustrated and described as embodied in a method and apparatus for regulating the pressure at which the roof shield of a mine roof support is pressed by hydraulically operated extensible and collapsible props against the roof of a mine gallery and in which the pressure is regulated independent on the inclination of the props with respect to the sole plate of the mine roof support or the length of the extended props, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of controlling a mine roof support including a sole plate resting on the sole of a mine gallery, a roof shield engaging the roof of the mine gallery, and pressure fluid-operated extensible and collapsible prop means extending between the sole plate and the roof shield for pressing the latter against the roof of the mine gallery and having at least one elongated cylinder element and a piston reciprocally arranged in said one cylinder element and dividing the latter into two compartments, into one of which pressure fluid is to be fed for extending the prop means, the method comprising the steps of providing an overpressure valve and connecting said valve with said one compartment, said overpressure valve developing an opening pressure which controls pressure in said one compartment; measuring the inclination of said prop means with respect to the sole plate or measuring the extended length of said prop means; transporting the thus measured value into a control command and transmitting said control command to said overpressure valve to adjust said opening pressure in dependence on the inclination of said prop means with respect to said sole plate or the extended length of said prop means, so that during extension of said prop means to press the roof shield against the roof of the mine gallery further extension of said prop means is automatically stopped when the pressure in said one compartment reaches a controlled opening pressure of said overpressure valve.

2. A method as defined in claim 1, wherein in addition to measuring the inclination of said prop means with respect to said sole plate also the pressure in said one compartment is measured, and wherein the measuring results are compared with desired values and transformed into control commands controlling valves which cooperate with said overpressure valve for controlling the opening pressure of the latter.

3. A control arrangement for a mine roof support including a sole plate resting on the sole of a mine gallery, a roof shield engaging the roof of the mine gallery, and fluid-operated extensible and collapsible prop means extending between the sole plate and the roof shield for pressing the latter against the roof of the mine gallery and including at least one elongated cylinder element and a piston element reciprocally arranged in said cylinder element and dividing the latter into two compartments into one of which pressure fluid is fed for extending the prop means, said control arrangement comprising an overpressure valve communicating with said one compartment; means for measuring the inclination of said prop means with respect to said sole plate; a transducer in circuit with said inclination measuring means for transforming the measured inclination into a control signal which controls the opening pressure of said overpressure valve.

4. A control arrangement as defined in claim 3, further including a converter and a calculator connected to said transducer.

5. A control arrangement as defined in claim 4, wherein said calculator is programmed for a predetermined characteristic curve of construction.

6. A control arrangement as defined in claim 4, wherein said overpressure valve is a magnetically controlled stop valve.

* * * * *